United States Patent [19]

Holtmann et al.

[11] Patent Number: 4,784,823

[45] Date of Patent: Nov. 15, 1988

[54] CORROSION PROTECTION

[75] Inventors: Werner Holtmann, Enger; Hartmut Kroll, Hanau; Gunther Luthardt, Rodenbach; Volker Portscher, Haibach, all of Fed. Rep. of Germany

[73] Assignee: Nukem GmbH, Hanau, Fed. Rep. of Germany

[21] Appl. No.: 344,966

[22] Filed: Feb. 2, 1982

[30] Foreign Application Priority Data

Feb. 3, 1981 [DE] Fed. Rep. of Germany ..... 3103558

[51] Int. Cl.[4] ..... G21F 1/00

[52] U.S. Cl. ..... 376/272; 204/147; 250/506.1; 252/633; 422/903

[58] Field of Search ..... 204/147, 148, 196, 197; 376/272; 252/633; 422/903; 250/506.1

[56] References Cited

U.S. PATENT DOCUMENTS

| | | | |
|---|---|---|---|
| 2,303,778 | 12/1942 | Wesley | 204/197 |
| 2,478,479 | 8/1949 | Grebe et al. | 204/197 |
| 2,480,087 | 8/1949 | Robinson et al. | 204/197 |
| 2,541,062 | 2/1951 | Hoxeng | 204/148 |
| 2,565,544 | 8/1951 | Brown | 204/197 |
| 2,601,214 | 6/1952 | Robinson | 204/197 |
| 2,621,154 | 12/1952 | Mears | 204/197 |
| 2,645,612 | 7/1953 | Taylor | 204/197 |
| 2,758,082 | 8/1956 | Rohrman | 204/197 |
| 3,192,144 | 6/1965 | Heuze | 204/148 |
| 4,107,017 | 8/1978 | Sabins | 204/148 |
| 4,196,055 | 4/1980 | Lennox, Jr. | 204/1 C |
| 4,376,753 | 3/1983 | Lucas | 376/305 |

OTHER PUBLICATIONS

*A Guidebook to Nuclear Reactors,* Anthony V. Nero, Jr., 1979, pp. 178 and 179.

*Primary Examiner*—Deborah L. Kyle
*Assistant Examiner*—Richard W. Wendtland
*Attorney, Agent, or Firm*—Cushman, Darby & Cushman

[57] ABSTRACT

There is described an apparatus for the corrosion protection of containers for the long time storage of radioactive materials, especially of spent fuel elements, in suitable geological formations which avoid corrosion of the container even with unexpected occurrence of water, or at least delay and minimize the corrosion. The apparatus consists essentially of sacrificial anodes 2 which are conductively joined to the containers 1 via connections 3.

28 Claims, 1 Drawing Sheet

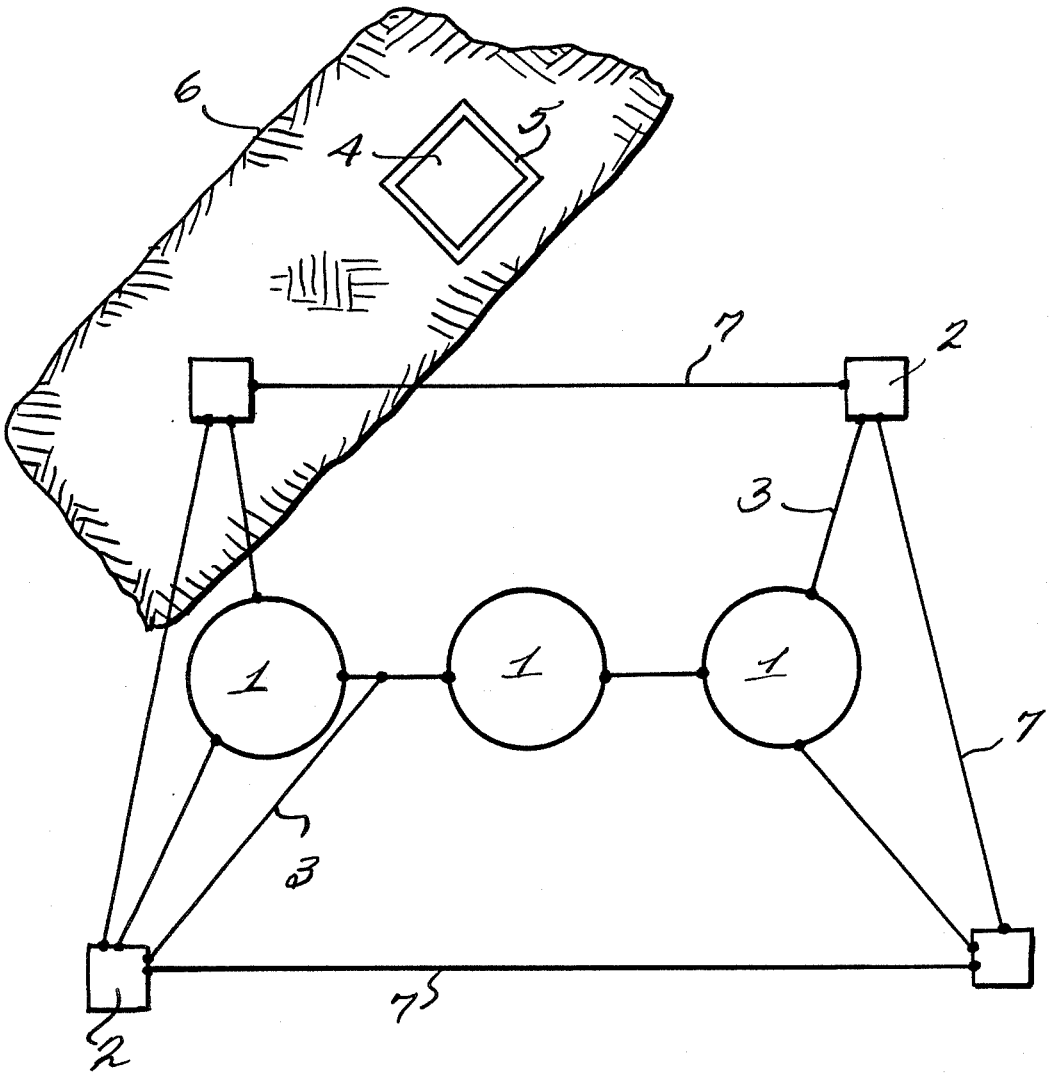
6
4
5
7
2
3
1
1
1
7
3
7
2
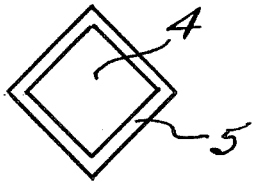
4
5

CORROSION PROTECTION

BACKGROUND OF THE INVENTION

The object of the invention is an apparatus for the corrosion protection of containers for the long time storage of radioactive materials, especially from spent fuel elements, in suitable geological formations.

Spent fuel elements are worked up after a temporary storage in water basins either immediately or after a limited further intermediate storage up. Thereby, the nuclear fuel and breeder material of the fission products are separated and returned to the fuel cycle. The fission products are conditioned according to known processes, for the most part using large amounts of valuable materials, as for example, lead and copper and are finally stored in non-retrievable manner in suitable geological formations such as salt blocks.

Furthermore, it has been proposed (reports of the Kernforschungszentrum Karlsruhe KFK 2535 and 2650) not to work up the irradiated fuel elements in the foreseeable future, to give up the fuel and breeder materials in them and, after a suitable decay time in storages provided therefore, finally store the fuel elements in salt formations. The storage time of the spent fuel elements thus can be hundreds of years.

Because of the undetermined storage time, special requirements are placed on such containers suited for the long time and final storage. Increasing the difficulty is the fact that the container storage must be accessible only with difficulty, and consequently limits are placed on the possiblity of supervision or supervision is even excluded.

Concepts are known which in part involve great expense to store the spent fuel elements or radioactive waste by means of containers made of metal or concrete in geological formations as, e.g. in dry salt blocks (Report of the Kernforschungszentrum Karlsruhe KFK 3000).

However, the use of concrete is problematical since long time experience over hundreds or in a give case over thousands of years naturally is not present. Metal containers, e.g. of steel, cast iron, especially spherical graphite cast iron, lead, copper, or other materials also have disadvantages. Among others, these are partially in the production costs, above all, however, in the area of corrosion, since among others water penetration, even though there is only a slight possibility of occurrence, must be included in safety considerations.

The invention therefore is based on the problem of providing an apparatus for the corrosion protection of containers for the long time storage of radioactive materials, especially spent fuel elements, in suitable geological formations which avoid the corrosion of the containers in the event of unexpected occurrence of water or at least delay and reduce such corrosion.

SUMMARY OF THE INVENTION

The problem was solved according to the invention by conductively joining the containers with sacrificial anodes via connections.

BRIEF DESCRIPTION OF THE DRAWINGS

The single figure of the drawing is a schematic illustration of the apparatus of the invention.

DETAILED DESCRIPTION

Referring more specifically to the drawings long time storage containers 1 are located in a geological formation 6, e.g. a salt block. In the containers are radioactive materials such as waste and spent fuel elements for final disposal. In the vicinity of these containers sacrificial anodes 2 are arranged whereby the sacrificial anodes are conductively joined to the container 1 via connections 3. Through this there is guaranteed an anodic corrosion protection which is effective if there is an occurrence of moisture in the storage place. The electrolyte formed by the water, for example a salt solution, builds up a voltaic cell. Through this, the sacrifical anode 2 dissolves and the container 1 with its radioactive inventory connected as cathode remains protected.

As the container 1 there can be used, for example, iron or iron containing material, e.g. steel, lead, copper, etc.

As sacrificial anodes there can be used metals with appropriate electrochemical properties considering the material of the container 1 in each case. Thereby it is especially favorable if the potential difference between the container 1 and the sacrificial anode 2 is between 50 and 1000 mV, since the dissolution of the sacrificial anode as a gage of the corrosion protection is influenced advantageously. It is especially advantageous to use as sacrificial anode 2 zinc or zinc containing shaped bodies because of their availability and electrochemical behavior. The shaped bodies for example, can consist of zinc and lead and advantageously be produced by powder metallurgy using pressing, since then displacements in potential which possibly could occur through the alloying components are avoided. The speed of dissolution can be influenced favorably by powder metallurgically produced sacrificial anodes.

The sacrificial anodes 2 are usually formed in solid geometry. However, in some cases other geometries are also possible. Among others, the sacrificial anodes in many cases also can be accomodated in or inserted into tanks or superposed containers which receive the container 1.

As material for the conductive connections 3 the same type of material can be used the same type of material as for the container 1. However, it is also possible to employ graphite as conductive material which only serves to lead off the electrons formed in the electrochemical reaction. In using several sacrificial anodes 2 these are suitably joined together through conductive connections 7.

It is especially favorable if a material supply 4 with a potential more noble than that of the material of container 1 is additionally arranged spatially near to the containers 1 and the sacrificial anode 2. As material supply 4 which in the normal condition is not in conductive connection with the container 1 there can be used e.g., copper salts, e.g. cupric sulfate, or cupric chloride. In the case of penetration of electrolytes into the storage, after a certain time e.g. copper ions will also go into the solution from the material supply, e.g. copper ions. In exchange for the, for example, iron ions of the containers 1, these copper ions can precipitate on the container 1 and form a coating which can contribute to the protection against corrosion.

For reasons of cost and availability it is advantageous if the material supply 4 consists of copper sulfate.

Furthermore, it is advantageous if the material supply 4 is enclosed in a metal jacket 5 which in turn is less noble than the container 1 and than the material supply 4, but is equally noble or nobler than the sacrificial anode 2. Through this, sacrificial anode 2 and then the jacket 5 will dissolve before the material supply 4 in case of penetration of electrolyte into the storage. In this manner an additional corrosion reducing coating is produced on the container 1 coming from the material supply 4. Thus when the sacrificial anode is made of zinc, the jacket 5 can be made of zinc or more noble material (but less noble than container 1 or material supply 4).

The apparatus of the invention in a surprising manner produces a long time effective retardation of corrosion on the container 1 and therewith contributes to guarantee the exclusion from the biosphere even in the most unfavorable accidental event, which is normally not to be expected, until the radioactivity of the container inventory has faded.

The apparatus can comprise, consist essentially of or consist of the stated elements.

The entire disclosure of German priority application No. P 3103558.2 is hereby incorporated by reference.

We claim:

1. An apparatus for the protection against corrosion of a container means made of metal for the long time storage of radioactive material in a suitable geological formation comprising (1) said container means, (2) sacrificial anode means made of metal conductively connected thereto in said geological formation, and (3) arranged spatially near the container and the sacrifical anode means a material supply which is made of a material having a nobler potential than that of the container means.

2. An apparatus according to claim 1 containing radioactive material therein.

3. An apparatus according to claim 2 wherein the radioactive material is spent fuel elements.

4. An apparatus according to claim 2 wherein the geological formation is a salt block.

5. An apparatus according to claim 1 wherein the potential difference between the container means and the sacrificial anode means is between 50 and 1000 mV.

6. An apparatus according to claim 5 wherein the sacrificial anode means comprises zinc.

7. An apparatus according to claim 6 wherein the container means comprises iron.

8. An apparatus according to claim 1 wherein the sacrificial anode means comprises zinc.

9. An apparatus according to claim 1 wherein the material supply is a copper salt.

10. An apparatus according to claim 9 wherein the container means comprises iron.

11. An apparatus according to claim 6 wherein the container means comprises iron.

12. An apparatus according to claim 1 wherein the material supply is copper sulfate.

13. An apparatus according to claim 12 wherein the container means comprises iron.

14. An apparatus according to claim 5 wherein the material supply is copper sulfate.

15. An apparatus according to claim 6 wherein the material supply is copper sulfate.

16. An apparatus according to claim 15 wherein the container means comprises iron.

17. An apparatus according to claim 14 wherein the material supply is copper sulfate.

18. An apparatus according to claim 17 wherein the material supply is surrounded by a metal jacket which is less noble than the container means and the material supply but is at least as noble as the sacrificial anode.

19. An apparatus according to claim 16 wherein the material supply is surrounded by a metal jacket which is less noble than the container means and the material supply but is at least as noble as the sacrificial anode.

20. An apparatus according to claim 15 wherein the material supply is surrounded by a metal jacket which is less noble than the container means and the material supply but is at least as noble as the sacrificial anode.

21. An apparatus according to claim 14 wherein the material supply is surrounded by a metal jacket which is less noble than the container means and the material supply but is at least as noble as the sacrificial anode.

22. An apparatus according to claim 13 wherein the material supply is surrounded by a metal jacket which is less noble than the container means and the material supply but is at least as noble as the sacrificial anode.

23. An apparatus according to claim 12 wherein the material supply is surrounded by a metal jacket which is less noble than the container means and the material supply but is at least as noble as the sacrificial anode.

24. An apparatus according to claim 9 wherein the material supply is surrounded by a metal jacket which is less noble than the container means and the material supply but is at least as noble as the sacrificial anode.

25. An apparatus according to claim 1 wherein the material supply is surrounded by a metal jacket which is less noble than the container means and the material supply but is at least as noble as the sacrificial anode.

26. An apparatus according to claim 5 wherein the material supply is surrounded by a metal jacket which is less noble than the container means and the material supply but is at least as noble as the sacrificial anode.

27. An apparatus according to claim 6 wherein the material supply is surrounded by a metal jacket which is less noble than the container means and the material supply but is at least as noble as the sacrificial anode.

28. An apparatus according to claim 8 wherein the material supply is surrounded by a metal jacket which is less noble than the container means and the material supply but is at least as noble as the sacrificial anode.

* * * * *